United States Patent [19]

Wehling et al.

[11] Patent Number: 4,834,763

[45] Date of Patent: May 30, 1989

[54] PROCESS FOR THE RETANNING OF CHROME LEATHERS

[75] Inventors: Bernhard Wehling, Bergisch Gladbach; Josef Müller; Helga Rosentreter, both of Leverkusen, all of Fed. Rep. of Germany

[73] Assignee: Bayer Aktiengesellschaft, Leverkusen, Fed. Rep. of Germany

[21] Appl. No.: 185,198

[22] Filed: Apr. 22, 1988

Related U.S. Application Data

[63] Continuation of Ser. No. 867,355, May 27, 1986, abandoned.

[30] Foreign Application Priority Data

May 30, 1985 [DE] Fed. Rep. of Germany ..... 3519287

[51] Int. Cl.[4] ..... C14C 3/06

[52] U.S. Cl. ..... 8/94.26; 8/94.27

[58] Field of Search ..... 8/94.19 R, 94.26, 94.24, 8/94.27

[56] References Cited

U.S. PATENT DOCUMENTS 4,042,321 8/1977 Backer et al. ..... 8/94.26

OTHER PUBLICATIONS

Dr. B. Magerkurth and Dr. F. F. Miller, Fashion and Ecological Aspects On Modern Rettanages, The Leather Manufacturer, Aug. 1981, pp. 10–31.

*Primary Examiner*—Paul Lieberman
*Assistant Examiner*—John F. McNally
*Attorney, Agent, or Firm*—Sprung Horn Kramer & Woods

[57] ABSTRACT

The present invention relates to a process for the retanning (afterchroming) of chrome leathers. It has been found very high chromium exhaustion of the liquor can be achieved if the leather is retanned with mixtures of, (a) chromium (III) salts, (b) from 1.0 to 2.5 mol (per mole of $Cr_2O_3$ of the used chromium(III) salt) of aliphatic dicarboxylic acids having from 4 to 6 carbon atoms or aromatic dicarboxylic acids having from 8 to 12 carbon atoms and/or the salts thereof, (c) such a quantity of basifying agents, that a theoretical basicity of the used chromium(III) salt of from 80 to about 120% is established, and (d) from 150–250 g (per mol of $Cr_2O_3$ of the used chromium(III) salt) of one or more synthetic tanning agents (syntans).

5 Claims, No Drawings

PROCESS FOR THE RETANNING OF CHROME LEATHERS

This is a continuation, of application Ser. No. 867,355, filed May 27, 1986, now abandoned.

The present invention relates to a process for the retanning (afterchroming) of chrome leathers, in which chromium(III) salts are used and a very high chromium exhaustion of the liquor is achieved.

In the case of a conventional afterchroming, the chrome leathers are washed, treated with a chromium-(III) salt, possibly in the presence of a syntan, and then adjusted to a pH, depending on the leather type, of from 4 to 7 in new or in the same liquor with the known acid-binding agents such as sodium or ammonium carbonate, sodium formate and others. With these processes, often less than half the chromium tanning agents supplied are fixed by the leather. In the course of the following operations, a further proportion of the unbound chromium is dissolved out of the leather (c.f. S.C. O'Connor, The Leather Manufacturer 1984, 8, 20–29).

There has thus been no shortage of attempts to improve the chromium exhaustion in afterchroming.

Thus, for example, combinations of chromium(III) salts, sodium sulfite and heterocyclic compound releasing an intermediary formaldehyde, were used (c.f. S.C. O'Connor loc. cit.). Apart from the presence of formaldehyde which is often undesirable for ecological reasons, a pH of, for example, 6.9 must be set in this process in the liquor to achieve a high exhaustion. A pH of this order of magnitude is, however, only conventional in the neutralization of upholstery or clothing leathers to be dyed thoroughly.

In the case of uppers, on the other hand, such a pH leads to leathers with impaired grain consistency and grain fineness (see also U.S. Pat. No. 3,888,625).

It was furthermore proposed to use substantially buffering syntan mixed products in combination with magnesium oxide for neutralization of afterchromings (c.f. Wachsmann und Hilzinger, Leder- und Häutemarkt 32 (1980), 188–191).

In this process also, a pH of about 6 must be set to maintain an exhaustion of about 0.1 g of $Cr_2O_3$/1. The high pH and the laborious separate addition of the products have so far, however, prevented the methods from becoming widespread.

In addition, it was also attempted to improve the chromium exhaustion of the retanning liquors by additions of dicarboxylic acid salts. In order to avoid chromium precipitations owing to the high alkalinity of these salts additional large quantities of masking agents must be supplied, which however in turn inhibit a good chromium exhaustion. High quantities of cross-linking dicarboxylic acids and a higher end-pH than 4,0 result, according to this process, in an impaired grain fineness and colouring uniformity (Magerkurth and Miller, The Leather Manufacturer 1981, 8, 10–31).

It has now been found that the exhaustion of retanning liquors can be substantially improved if the chrome leathers are retanned with mixtures of (a) chromium(III) salts, (b) from 1.0 to 2.5 mol (per mol of $Cr_2O_3$ of the chromium (III) salt used), preferably from 1.5 to 2.3 mol of aliphatic dicarboxylic acids having from 4 to 6 carbon atoms or aromatic dicarboxylic acids having from 8 to 12 carbon atoms and/or the salts thereof, (c) such quantities of calcium carbonate and/or dolomite as well as optionally other basifying agents, that with regard to the dicarboxylic acids and basifying agents used, a theoretical basicity of the used chromium salt of from 80 to 120% is established, whereby the molar ratio of the remaining basifying agents to calcium carbonate and/or dolomite is from 0–3:1, and (d) from 150 to 250 g (per mol of $Cr_2O_3$ of the used chromium tanning agent) of a synthetic organic tanning agent (syntan) or syntan mixture.

The present invention thus provides a process for the retanning of chrome leathers, which is characterized by carrying out the retanning with a mixture comprising (a) chromium(III) salts, (b) from 1.0 to 2.5 mol (per mol of $Cr_2O_3$ of the used chromium(III)salt) of aliphatic dicarboxylic acids having from 4 to 6 carbon atoms or aromatic dicarboxylic acids having from 8 to 12 carbon atoms and/or the salts thereof (c) such quantities of basifying agents, that a theoretical basicity of the used chromium(III) salt of from about 80 to 120% is established and (d) from 150 to 250 g (per mol of $Cr_2O_3$ of the used chromium(III) salt) of one or more synthetic tanning agents (syntan).

The retanning thereby usefully takes place with volumes of liquor or greater than 100% (based on shaving weight) and liquor temperatures of from 35° to 55° C. over a period of from 1.5 to 4 hours with an end pH of greater than 4.0. The $Cr_2O_3$ supply is from 0.3 to 1.0% (based on shaving weight), preferably from 0.4 to 0.6% (based on shaving weight).

The conventional chromium(III) salts used for chromium tanning are suitable as chromium(III) salts for retanning, particularly chromium(III) sulfates, basic chromium(III) sulfates, moreover chromium(III) salts masked with organic acids, for example formic acid or acetic acid, chromium tanning agents which in addition to chromium(III) salts also contain inorganic salts such as sodium sulfate or reaction products of hexavalent chromium compounds with reducing agents.

Aliphatic dicarboxylic acids having from 4 to 6 carbon atoms are, for example, succinic acid, glutaric acid, adipic acid, maleic acid, fumaric acid, aspartic acid, glutamic acid, or mixtures thereof. Glutaric acid and adipic acid or mixtures of these acids are preferably used, optionally with other dicarboxylic acids.

Aliphatic dicarboxylic acids having from 4 to 6 carbon atoms which contain a hydroxy group in the alphaposition to the carboxyl group and/or the sulphonic acid groups, should only be used simultaneously as up to about ⅓ of the total dicarboxylic acid quantities used.

Aromatic dicarboxylic acids having from 8 to 12 carbon atoms are those of the benzene and naphthaline series, which in addition to the carboxyl groups can also contain hydroxy, amino or nitro groups and/or halogen atoms. Phthalic acid and isophthalic acid are preferably used.

The carboxylic acids can be used both in the form of free acids, in the form of mixtures of free acids and the salts of such carboxylic acids and also alone in the form of salts, suitably alkali metal salts.

Anionic aromatic syntans (c.f. Ullmanns Encyklopädie der technischen Chemie, Verlag Chemie, Weinheim, 4th edition, volume 16 (1978), p. 138–139), aromatic syntans of lignosulfonates (c.f. Ullmann, loc. cit. p. 139), resin tanning agents (c.f. Ullmann, loc. cit. p.

144) or mixtures thereof can be used as synthetic organic tanning agents.

Suitable syntans are, for example, formaldehydecondensation products of naphthaline- sulfonic acid, diarylether sulfonic acid, polyphenyl sulfonic acid, phenol sulfonic acid, and naphthaline-sulfonic acid-4,4'-dihydroxy-diphenyl-sulfone, polyphenyl-sulfonic acids, ligninosulfonic acids and mixtures thereof. Also suitable are hydrolysates of proteins (cf. K. Faber, Bibliothek des Leders, Bd. 3, Umschau-Verlag, Frankfurt/M, p. 236).

Dicyandiamide-formaldehyde condensation products as well as mixtures thereof with anionic dispersing agents based on lignosulfonates or naphthaline-sulfonic acid are preferably used.

Alkali- or ammonium carbonates and magnesium oxide are suitable as basifying agent in addition of calcium carbonate and/or dolomite.

Magnesium oxide or sodium bicarbonate or mixtures thereof are preferably used.

Dolomite refers to the mineral double salt $CaCO_3.MgCO_3$, which has a content of from 20 to 40% of CaO, preferably from 25 to 35% of CaO and an MgO content of from 10 to 25% preferably from 16 to 24% of MgO.

The additions of calcium carbonate and/or dolomite and the remaining basifying agents depend on the basicity of the used chromium salts as well as the degree of neutralization of the used dicarboxylic acids. They have to be calculated in such a manner that with regard to the dicarboxylic acids or the salts thereof, the calcium carbonate and/or the dolomite and the remaining basifying agents, the resulting theoretical basicity of the chromium salt is from 80 to 120%.

The calculation of the total basicity is illustrated in the following Example:

| Composition of the mixed product | (Equivalent weight) | Equivalents | Equivalents: Equivalents $Cr_2O_3$ | (Basicity) basicity change (%) |
|---|---|---|---|---|
| 494 g chromium sulfate 33% basic, 26% $Cr_2O_3$ | (25,33) | 5.07 ($Cr_2O_3$) | — | (+33) |
| 223 g glutaric acid | (66) | 3.38 | 0.67 | −67 |
| 51 g magnesium oxide (85% MgO) | (20.16) | 2.15 | 0.42 | +42 |
| 232 g calcium carbonate | (50.05) | 4.64 | 0.92 | +92 |
| 1000 g | | | total basicity | 100% |

In the process according to the invention, wet-blues chromium tanned, de-watered and shaved in the conventional manner, are retanned in the described manner, preferably without previous washing. Subsequent to retanning the leather can be further basified, if necessary, in the same or in new liquor by addition of neutralizing agents. They are then dyed in the conventional manner, retanned, possibly with vegetable tanning agents and/or syntans, stuffed etc.

Numerous conventional chrome leather types from the skins of cattle and horses or smaller animals are suitable for the process according to the invention, including the corresponding split leathers.

The use of mixtures of chromium(III) salts, acidbinding agents and aliphatic or aromatic dicarboxylic acids has already been described (c.f. DE-AS No. 24 24 300 and DE-AS No. 24 24 301). The mixtures were hereby however not used for the retanning of wet-blues, but for chromium tanning of skin free from hair. The tanning conditions ($Cr_2O_3$ supply: at least 1.2%, volume of liquor: max 100%, on the weight of skin free from hair) differ basically, however, from those of the retanning according to the invention.

The value of the process consists in that it produces evenly-dyed, full, soft, fine-grained and grain-fast leathers by a very simple process and simultaneously causes a high chromium exhaustion of the retanning liquors. The residual liquors have chromium oxide contents of less than 0.5 g of $Cr_2O_3$/l according to the volumes of liquor, running time and temperature.

It was not predictable that the exhaustion would be so substantially improved by the common use of the materials according to the invention, without deterioration of the grain fineness and gain consistency of the leathers as well as of the evenness of the dying in spite of the use of at least 1.5 mol of dicarboxylic acids per mol of $Cr_2O_3$ of the used chromium salt, and an end-pH of the residual liquor of greater than 4.0.

The process according to the invention is explained in more detail by means of the following Examples (% data are % by weight):

EXAMPLE 1

Retanning of chromium-tanned, shaved cowshide or calf leathers (end-pH of the chromium tanning: 3.6)
200% of water 50° C.
4.5% of chromium syntan tanning agent* (=0.5% of $Cr_2O_3$)
drumming for 2.5 hours pH of the liquor: 4.9
$Cr_2O_3$ content of the liquor: 0.2 g/l
liquor drained
100% of water 60° C.
1 % of anionic commercial dye,
drumming for 30 min
pH: 4.7
+6 % of a greasing agent of natural and synthetic fatty substances (content of fatty substances: about 60%)
3 % of a greasing agent based on lanolin (content of fatty substances: about 50%)
about 40% of water emulsified
drumming for 45 min
pH: 4.7
0.5% of 85% formic acid (1:5)
pH of the liquor: 3.9 liquor drained, leather rinsed and worked up as usual.

* The used chromium syntan mixed tanning agent has the following composition.

Leathers are obtained which are characterized by a uniform, deep colouring, a soft, full feel and by an outstanding grain consistency and grain smoothness.

418 parts by weight of a commercial 33% basic chromium-(III) sulfate with about 26% of $Cr_2O_3$
189 parts by weight of technical glutaric acid
43 parts by weight of magnesium oxide (85% MgO)
210 parts by weight of calcium carbonate and
140 parts by weight of a dicyandiamide formaldehyde condensation product $Cr_2O_3$ content: about 11% theoretical basicity: 106%
Mol of glutaic acid/mol of $Cr_2O_3$: 2
Mol of MgO/mol of $CaCO_3$: 0.44

EXAMPLE 2

Process as described in Example 1.

The retanning is carried out with water at a temperature of 60° C. instead of with 50° C. water.

The $Cr_2O_3$ content of the retanning liquor is 0.1 g/l.

The leathers obtained are identical to those produced according to Example 1.

EXAMPLE 3

Process as described in Example 1. The syntan proportion of the mixed agent consists of 140 parts by weight of a commercial auxiliary tanning agent based on ditolylether sulfonic acid.

$Cr_2O_3$ content of the subsequent tanning liquor: about 0.25 g/l, pH: 4.6.

The leathers have a somewhat lighter colouring than those produced accoring to Example 1. Otherwise they are comparable in all properties.

EXAMPLE 4

Process as in Example 1. Instead of the chromium syntan tanning agent used in Example 1, 0.5% of the products I–III, based on $Cr_2O_3$, are used.

Composition (in parts by weight)

| | I | II | III |
|---|---|---|---|
| Chromium (III) sulfate (26 $Cr_2O_3$, 33% basic) | 411 | 410 | 398 |
| disodium phthalate: | 296 | — | — |
| adipic acid | — | 205 | — |
| isophthalic acid: | — | — | 227 |
| magnesium oxide: (85% MgO) | — | 42 | 41 |
| calcium carbonate: | 155 | 206 | 200 |
| dicyandiamide resin: (see Example 1) | 138 | 137 | 134 |
| | 1000 | 1000 | 1000 |
| $Cr_2O_3$ content (%): | 10.7 | 10.6 | 10.3 |
| theoretical basicity (%): | 106 | 106 | 106 |
| mol of dicarboxylic acid/ mol of $Cr_2O_3$: | 2 | 2 | 2 |
| mol of MgO/mol of $CaCO_3$: | 0 | 0.43 | 0.44 |
| pH of the retanning liquor: | 4.8 | 4.9 | 5.1 |
| $Cr_2O_3$-content (g/l): | 0.4 | 0.2 | 0.1 |

EXAMPLE 5

Process as described in Example 1. In place of the chromium syntan tanning agent used in Example 1, 0.5% (based on $Cr_2O_3$) of the products IV–VI are used.

Composition (in parts by weight)

| | IV | V | VI |
|---|---|---|---|
| Chromium (III) sulfate (26% $Cr_2O_3$, 33% basic) | 444 | 433 | 406 |
| Technical glutaric acid: | 200 | 196 | 183.5 |
| Magnesium oxide (about 85% of MgO) | 45.5 | 44 | 41.5 |
| Calcium carbonate: | 162 | 182 | 233 |
| Dicyandiamide resin: (see Example 1) | 148.5 | 145 | 136 |
| | 1000 | 1000 | 1000 |
| % of $Cr_2O_3$: | 11.5 | 11.3 | 10.6 |
| % of theoretical basicity | 80 | 90 | 120 |
| mol of glutaric acid/mol of $Cr_2O_3$ | 2 | 2 | 2 |
| mol of MgO/mol of $CaCO_3$ | 0.6 | 0.51 | 0.38 |

-continued

| | IV | V | VI |
|---|---|---|---|
| pH of the retanning liquor: | 4.5 | 4.6 | 5.2 |
| $Cr_2O_3$ content (g/l) | 0.5 | 0.4 | 0.1 |

EXAMPLE 6

Retanning as described in Example 1. In place of 0.5% (based on chromium oxide content of the mixed product), 0.4% (based on chromium oxide content of the mixed product) are used.

pH of the retanning liquor: 4.7

$Cr_2O_3$ content of the retanning liquor: 0.3 g/l

EXAMPLE 7

Retanning as in Example 1. In place of 0.5% (based on chromium oxide content of the mixed product), 0.6% (based on chromium oxide content of the mixed product) are supplied.

pH of the retanning liquor: 5.1

$Cr_2O_3$ content of the retanning liquor: 0.2 g/l

EXAMPLE 8

Retanning as in Example 1. In place of the syntan component used in Example 1, equal quantities of a commercial synthetic organic tanning agent based on a mixture of diphenyl and terphenyl sulfonic acid are supplied.

The leathers have a deeper colouring than those obtained according to Example 1.

The exhaustion of the liquor remains unchanged.

EXAMPLE 9

Retanning of a upholstery leather-wet-blue (final pH of the chromium tanning: 4.1; shaving thickness 1.0–1.1 mm)

300 % of water 50° C.

4.5 % of chromium syntan mixed tanning agent (see Example 1) drumming for 2 hours pH of the liquor: 5.6

+0.5 % of sodium bicarbonate drumming for 30 min pH of the liquor: 6.5 $Cr_2O_3$ content of the liquor: 0.05 g/l liquor drained 300% of water 40° C. drumming for 10 min liquor drained.

Retanning, dying and stuffing is then carried out according to a formulation conventional for upholstery leathers.

The leather on a horse, set out, stretch wet, air-condition, stake, mill and stretch.

Upholstery leathers are obtained which are characterised by a soft, full feel, an even, deep colouring and a fine mill grain.

EXAMPLE 10

Retanning as in Example 1, but in place of the chromium syntan tanning agent used in Example 1, 4.5% (based on shaving weight) of the following mixture are used:

436 parts by weight of a commercial 33% basic chromium-(III) sulfate with about 26% of $Cr_2O_3$ 197 parts by weight of technical glutaric acid 72 parts by weight of magnesium oxide (85% MgO)

149 parts by weight of dolomite 146 parts by weight of dicyandiamide-formaldehyde condensation product $Cr_2O_3$ content: about 11%
theoretical basicity: 107%
mol of glutaric acid/mol of $Cr_2O_3$: 2
mol of MgO/mol of dolomite: 1.9

The end-pH of the retanning liquor is 4.9 and the $Cr_2O_3$ content is 0.2 g/l.

What is claimed is:

1. A process for the retanning of chrome leathers, wherein the retanning is carried out within the presence of a mixture comprising (a) chromium (III) salts in an amount such that the $Cr_2O_3$ supply is 0.1 to 1.0% , (b) from 1.0 to 2.5 mol (per mole of $Cr_2O_3$ of the used chromium (III) salt) of aliphatic dicarboxylic acids having from 4 to 6 carbon atoms of aromatic dicarboxylic acids having from 8 to 12 carbon atoms and/or the salts thereof (c) such a quantity of basifying agents, that a theoretical basicity of the used chromium(III) salt of from 80 to about 120% is established and (d) from 150–250 g (per mole of $Cr_2O_3$ of the used chromium(III) salt) of one or more synthetic tanning agents (syntans).

2. A process according to claim 1, wherein dicyanamideformaldehyde condensation products are used as the syntan as well as mixtures thereof with dispersing agents based on ligninosulfonate or naphthaline sulfonic acid.

3. A process according to claim 1 wherein calcium carbonate is used as basifying agent.

4. A process according to claim 1 wherein dolomite is used as basifying agent.

5. A retanning mixture comprising (a) a chromium(III) salt, (b) from 1.0 to 2.5 mol (per mol of $Cr_2O_3$ of the used chromium(III) salt) of an aliphatic dicarboxylic acids having from 4 to 6 carbon atoms or an aromatic dicarboxylic acid having from 8 to 12 carbon atoms and/or the salts thereof, (c) such a quantity of basifying agents that a theoretical basicity of the used chromium(III) salt of from about 80 to 120% is established, and (d) from 150 to 250 g (per mol of $Cr_2O_3$ of the used chromium(III) salt) of one or more synthetic tanning agents (syntan).

* * * * *